US009121162B1

(12) United States Patent
Kimble et al.

(10) Patent No.: US 9,121,162 B1
(45) Date of Patent: Sep. 1, 2015

(54) MOTOR COUPLER WITH MULTIPLE PICK UP LOCATIONS

(75) Inventors: Allen E. Kimble, Rock Spring, GA (US); Tracy C. Errera, Chattanooga, TN (US)

(73) Assignee: TAG Manufacturing, Inc., Chattanooga, TN (US)

( * ) Notice: Subject to any disclaimer, the term of this patent is extended or adjusted under 35 U.S.C. 154(b) by 484 days.

(21) Appl. No.: 13/584,039

(22) Filed: Aug. 13, 2012

(51) Int. Cl.
*E02F 9/00* (2006.01)
*E02F 3/36* (2006.01)
*E02F 3/96* (2006.01)

(52) U.S. Cl.
CPC ..... *E02F 3/3636* (2013.01); *E02F 3/96* (2013.01)

(58) Field of Classification Search
USPC ..... 37/468; 414/723; 403/322.3
See application file for complete search history.

(56) References Cited

U.S. PATENT DOCUMENTS 3,034,237 A * 5/1962 Wolfe et al. ..... 37/405
5,310,275 A * 5/1994 Lovitt ..... 403/322.3
5,529,419 A * 6/1996 Gebauer ..... 403/24
5,590,483 A * 1/1997 Kim ..... 37/468
5,692,850 A * 12/1997 Kimble et al. ..... 403/24
5,692,855 A * 12/1997 Burton ..... 403/325
6,196,595 B1 * 3/2001 Sonerud ..... 285/26
7,225,566 B1 * 6/2007 Kimble ..... 37/468
7,337,564 B2 * 3/2008 Kimble ..... 37/468
7,686,532 B2 * 3/2010 Kimble ..... 403/322.3
7,686,563 B2 * 3/2010 Frey et al. ..... 414/723
7,836,616 B2 * 11/2010 Esser et al. ..... 37/468
D643,051 S * 8/2011 Bercsik ..... D15/32
D645,063 S * 9/2011 Bercsik ..... D15/32
2008/0052969 A1 * 3/2008 Arosio et al. ..... 37/468
2008/0141566 A1 * 6/2008 Esser et al. ..... 37/468
2009/0051163 A1 * 2/2009 Frey et al. ..... 285/305
2010/0104359 A1 * 4/2010 Seda et al. ..... 403/359.5

* cited by examiner

*Primary Examiner* — Victor MacArthur
(74) *Attorney, Agent, or Firm* — Stephen J. Stark

(57) ABSTRACT

A hybrid male coupler portion for a front-end loader mates selectively and interchangeably with first, second or third different female coupler portions. The coupler portion includes a frame having first and second arm pin-on locations adapted for connection to associated first and second arms, respectively; at least one tilt member pin-on location adapted for connection to an associated tilt member; and first and second coupler halves including first, second and third hook-engaging mounts, first, second and third rib locking locations aligned with the respective hook-engaging mounts, plunger pin(s) slidably connected to the frame, movable between locked and retracted positions possibly moving toward the center line of the frame when locked or in opposing directions.

17 Claims, 5 Drawing Sheets

MOTOR COUPLER WITH MULTIPLE PICK UP LOCATIONS

FIELD OF THE INVENTION

The present invention relates to couplers and coupling systems for front end loaders, and more particularly to couplers having multiple pick up locations for attachments of various manufacturers' origin.

BACKGROUND OF THE INVENTION

Couplers and coupling systems for front-end loaders are well-known and widely used to provide for quick connect/disconnect of attachments, such as buckets, forks or the like, to the arms and tilt control linkage of a front-end loader or like machine. As used herein, the term "front-end loader" is intended to encompass front-end loaders and all other tractors and machines including two laterally spaced-apart arms and one or more tilt control cylinders, links, or the like that control the angular position of a male coupler portion and/or an attachment pivotally secured to the arms. Examples of known couplers and coupling systems of the general type disclosed herein can be found in commonly owned U.S. Pat. Nos. 4,708,579; 5,415,235; 5,529,419; and 5,692,850, the disclosures of which are hereby expressly incorporated by reference herein.

As is widely known in connection with loader coupling systems, a male coupler portion is operatively connected to the arms and control linkage of a front-end loader machine. The female coupler portion is defined by two parallel, spaced-apart ribs that are welded to otherwise fixedly secured to a bucket or other attachment such as forks or the like. Thus, the front-end loader is able to couple with any desired attachment by mating the male coupler portion to the female coupler portion of a desired attachment for use of the attachment.

FIG. 1A illustrates a first type of conventional female rib FR1. As is known in the art and as shown in FIG. 1C, two of the ribs FR1 are welded or otherwise fixedly secured vertically to a bucket or other attachment AT in parallel, spaced-apart relation to define a first type of female coupler portion B. Each rib FR1 comprises a hook portion FH1 and an ear portion FT1 spaced from the hook portion, but lying in the same plane therewith. The ear portion FT1 includes a lock aperture FA1 that extends transversely therethrough. In use, the hook portion FH1 is adapted to receive a mounting pin or other mounting member of a male coupler portion. The hook portion FH1 and mounting member of the male coupler portion typically comprise mating cylindrical surfaces. When the hook portion FH1 is seated on the mounting pin/member of the male coupler portion, the ear portion FT1 of the rib moves into a locking region of the male coupler portion where it is engaged by a lock mechanism to secure the rib FR1 to the male coupler portion in a releasable fashion. Typically, the lock mechanism comprises a plunger pin that is slidably received in the lock aperture FA1 of the ear FT1 so as to prevent withdrawal of the ear from the locking region of the male coupler portion which, in turn, prevents separation of the hook portion FH1 from the mounting pin/member that is seated therein. As noted, in practice, first and second ribs FR1 are used to define a female coupler portion B and, thus, the mating male coupler portion includes respective first and second mounting locations, and first and second lock mechanisms, to secure the ribs to the male coupler portion. The female rib FR1 shown in FIG. 1A is commonly referred to as a JRB-style rib in that two of the ribs FR1 arranged in an appropriate manner define a female coupler portion that is engageable by a male coupler portion available commercially from JRB Company, Inc., Akron, Ohio, U.S.A.

FIG. 1B partially illustrates a second type of conventional female rib FR2. As is known in the art, two vertical ribs FR2 are welded or otherwise fixedly secured to a bucket or other attachment in parallel, spaced-apart relation to define a second type of female coupler portion in the same arrangement as shown for the female coupler portion B in FIG. 1C. The rib FR2 functions similarly to the rib FR1 but is shaped and dimensioned differently, and the ribs FR2 are spaced differently relative to each other laterally to define a female coupler portion as compared to the ribs FR1. Each rib FR2 comprises a hook portion FH2 and an ear portion FT2 spaced from the hook portion but in the same plane therewith. The ear portion FT2 includes a transverse lock aperture FA2 that extends therethrough. In use, the hook portion FH2 is adapted to receive a mounting pin or other mounting member of a male coupler portion. The hook portion FH2 and mounting member of the male coupler portion typically comprise mating cylindrical surfaces. When the hook portion FH2 is seated on the mounting pin/member of the male coupler portion, the ear portion FT2 moves into a locking region of the male coupler portion where it is engaged by a lock mechanism to secure the rib FR2 to the male coupler portion. Here again, the lock mechanism of the male coupler portion typically comprises a plunger pin that is slidably received in the lock aperture FA2 of the tongue FT2 so as to prevent withdrawal of the ear FT2 from the locking region of the male coupler portion which, in turn, prevents separation of the hook portion FH2 from the mounting pin/member that is seated therein. As noted, in practice, first and second ribs FR2 are used to define a female coupler portion and, thus, the mating male coupler portion includes first and second mounting members, and first and second lock mechanisms, to secure the ribs to the male coupler portion. The female rib FR2 shown in FIG. 1B is commonly referred to as a CAT-style rib in that two of the ribs FR2 arranged in an appropriate manner define a female coupler portion that is engageable by a male coupler portion available commercially from Caterpillar, Inc., Peoria, Ill., U.S.A.

FIG. 1D illustrates a third type of conventional female rib FR3. The construction is similar to FR1 and FR2, but is commonly referred to as a Volvo-style rib in that two of the ribs FR3 arranged in an appropriate manner define a female coupler portion that is engageable by a male coupler portion available commercially by the Volvo Company.

The inventor, while working for a different company, developed the technology which eventually became U.S. Pat. No. 7,225,566. This coupler utilizes two cylinders which direct plunger pins into one of two coaligned receivers which held a rib of an implement with a bore therethrough. The pin passes through the receivers and each can hold a set of bores depending upon which of two different types of implants are selected. The implement and its ribs are then secured in one of two positions with the corresponding hub receiving a hook of the rib thereabove. U.S. Pat. No. 7,225,566 is incorporated herein in its entirety by reference.

Other companies such as Attachment Technologies, Inc. owner of U.S. Pat. No. 7,836,616 has also recognized the attractiveness of being able to provide a coupler which receives two attachments of various companies with different rib configurations. The technology shown and described in that reference is also incorporated herein by reference as well. That reference utilizes plunger pins which push separator parallel pins into engagement into one of two sets of bores through selected ribs.

None of the prior art shows three attachments with the ability to selectively connect to one of three different attachments, particularly such as a Cat IT attachment, a JRB 416 attachment and a Volvo attachment with automated locking capability. None of the prior art has a receiver vertically between a set of ribs which also provide a bore for pine on points to a loader. Furthermore, no prior art constructions provide a locking position engaged from a pin moving outwardly (unlocked) to inwardly (locked) or pins moving in outwardly and inwardly directions for the locked configuration.

SUMMARY OF THE INVENTION

Accordingly, it is a present object of the present invention to provide an improved method of connecting one of a plurality of different manufacturers implements (with different ear configurations) to a front end loader in an effective manner.

It is another object of many embodiments of the present invention to provide an improved coupler for a front end loader which accepts multiple ear configurations.

It is another object of the present invention to provide an improved coupler for a front end loader which accepts at least three attachments and automatedly locks a selected attachment in one of three positions.

It is another object of the present invention to provide an improved coupler portion that automatedly locks at least one selected attachment with pin traveling internally towards the center of the coupler to a locking position.

It is another object of many embodiments of the present invention to provide a coupler which automatedly directs plunger pins from opposing directions to selectively lock ears of an attachment.

Finally, it is another object of many embodiments to provide a set of ribs defining a location for accepting a locking pin to engage a loader as well as a set of bores for receiving a pin to lock an ear if a rib of an implement.

Accordingly, a presently preferred embodiment of the present invention provides a coupler having a frame which includes (i) first and second pin locations for connection to associated first and second arms of a loader such as a front end, respectively; (ii) at least one tilt member pin location adapted for connection to and associated tilt member of the front end loader; and (iii) first and second coupler halves.

Each of the first and second coupler halves preferably provide: a first hook-engaging mount; a first rib locking location vertically aligned with the first hook-engaging mount; a second hook-engaging mount; a second rib locking location vertically aligned with the second hook-engaging mount; a third hook-engaging mount; a third rib locking location vertically aligned with the third hook engaging mount; and preferably at least one of first, second and third plunger pins which when extended, lock and engage and retain an associated ear portion of an implement located in the appropriate first, second and third locking locations. The pin(s) are moved between locked and disengaged positions.

In accordance with another aspect of the invention, a male coupler portion comprises a first pair of mounts adapted for respective engagement with a first pair of ribs of a first associated female coupler portion configuration, a second pair of mounts adapted for respective engagement with a second pair of ribs of a second associated female coupler portion configuration, and a third pair of mounts adapted for respective engagement with a third pair of ribs of a third associated female coupler portion. Left and right first, second and/or third rib locking plunger pins move between locked and unlocked (i.e., disengaged) configurations as directed by an operator to selectively lock and/or release the respective pair of ribs so that an attachment or implement can be selectively connected and/or detached from the coupler as desired by the operator.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1A:
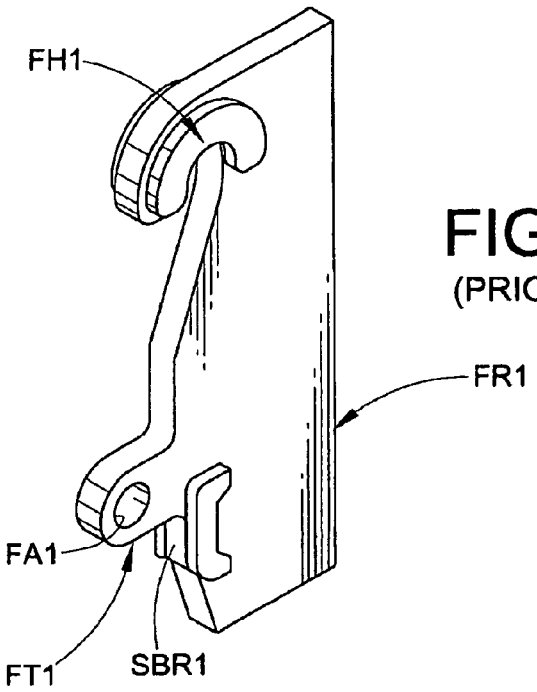
FIG. 1A (PRIOR ART)
FIG. 1A (prior art) is an isometric illustration of a first type of conventional rib, two of which are used to define a first female coupler portion of an implement.
Figure 1D:
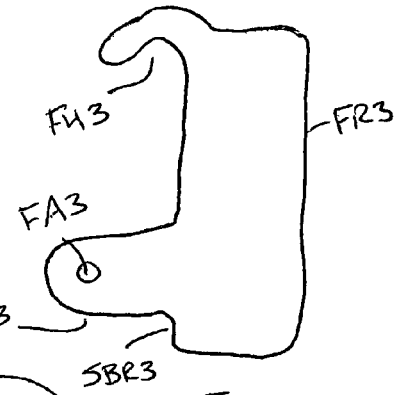
FIG. 1D (prior art) is a partial side elevational view of a third type of conventional female rib, two of which are used to define a third female coupler portion.
Figure 1B:
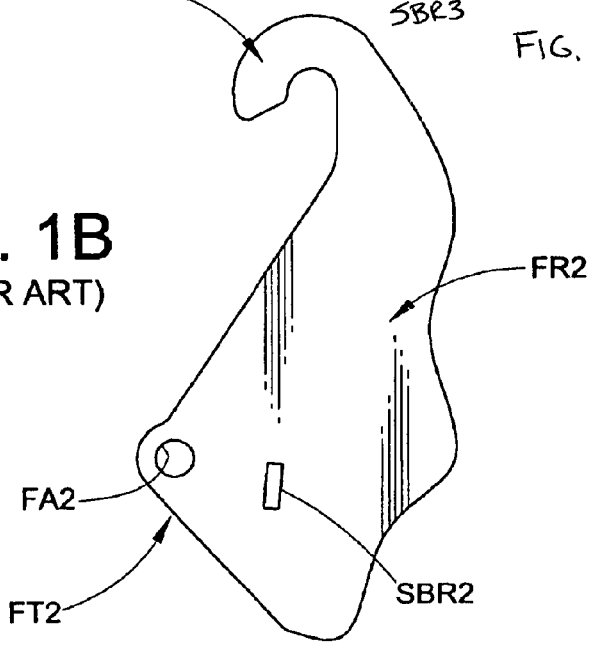
FIG. 1B (PRIOR ART)
FIG. 1B (prior art) is a partial side elevational view of a second type of conventional female rib, two of which are used to define a second female coupler portion of an implement.
Figure 1C:
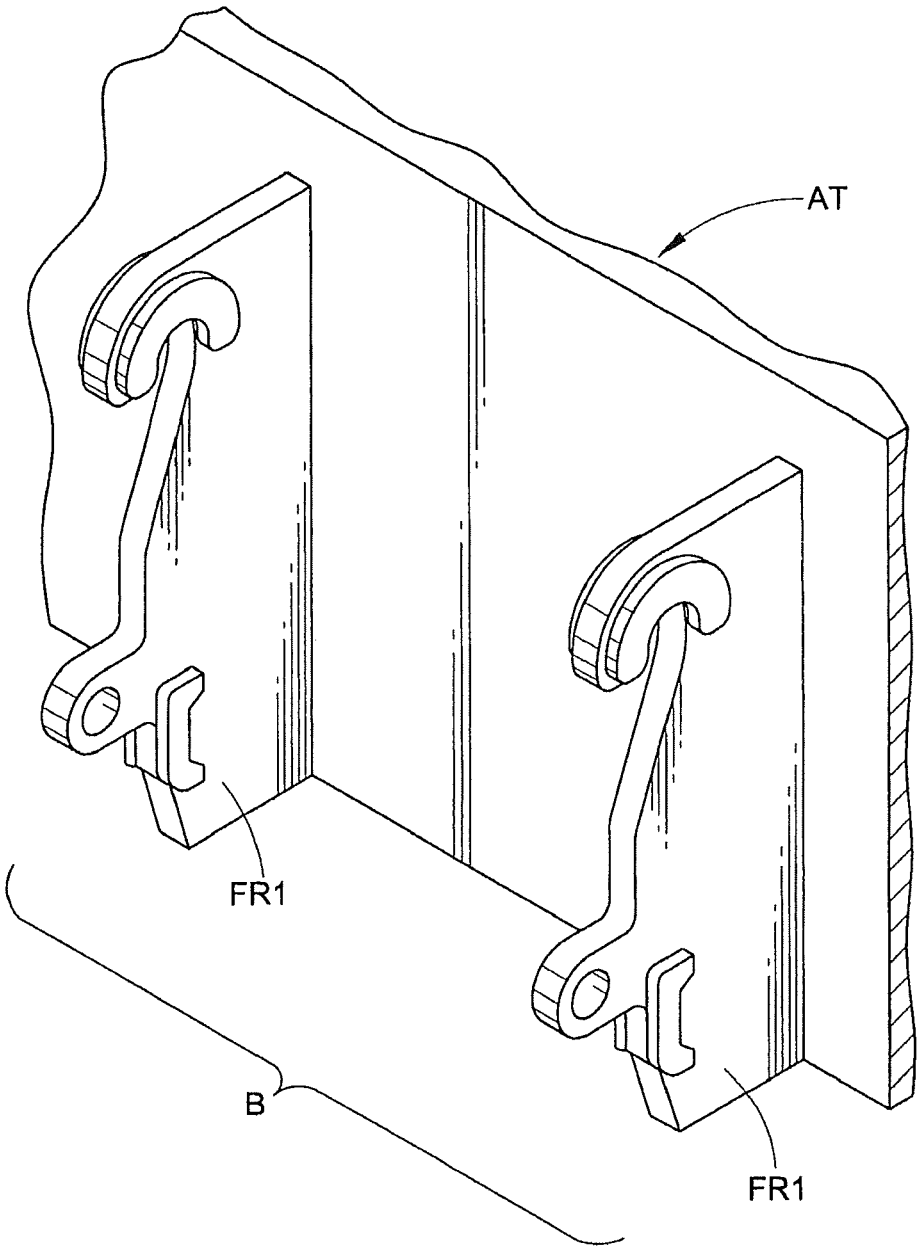
FIG. 1C (PRIOR ART)
FIG. 1C (prior art) illustrates a conventional female coupler portion defined by two of the ribs shown in FIG. 1A.

FIGS. 2-6 illustrate a male coupler portion A comprising a welded steel frame F and a first and second lock assemblies L1 and L2. The coupler A is defined by first and second lateral halves A1, A2 that are formed substantially symmetrical about a center line CL. Other embodiments may not require the symmetry of the preferred embodiment.

For ease of understanding the development, the male portion A is described herein as having a front region AF as oriented toward and engages in associated female coupler portion B to be defined by two ribs FR1, FR2 or FR3 depending upon which of the three different attachments are selected as will be described below and as understood by those of ordinary skill in the art. A rear region AR is oriented toward and connected via a pin on connection to an associated loader machine (not shown).

The frame F comprises a plurality of parallel, spaced-apart vertical ribs defined from steel plated or the like. In the illustrated embodiment, each half A1, A2 of the male coupler portion A comprises by a parallel ribs 10*a*,10*b*,10*c*,10*d*,10*e*. The ribs 10*a*,10*b* of each coupler half A1,A2 cooperate between an arm receiving channel C1 adapted to receive the distal end of the arm of an associated loader machine for at least some embodiments. The ribs 10*a*,10*b* define respective apertures 12*a*,12*b* that are aligned so as to define arm pin on points P1 (for coupler half A1) and P2 (for the coupler half A2). As such, the ribs 10*a*,10*b* of each coupler half A1,A2 are adapted for pin-on pivotable connections to associated parallel arms of a wheel or other loader at locations P1,P2 by means of the aligned apertures 12*a*,12*b*. This allows for the male coupler portion A to pivot relative to the loader arms about the pin-on points P1,P2 between dump and roll-back positions known in the art. Additionally, as has not been done in the prior art, the ribs 10*a*,10*b* further cooperate to provide a first rib locking location as will be discussed below.

The male coupler portion A is also configured for operative connection to one or more tilt control link-member such as linkages, cylinders, rods-eyes or the like. As shown, the associated tilt link or other tilt control member of the associated wheel loader is adapted for pivoting pin-lock on location to the male coupler portion A between the central ribs 10*e* of each coupler half A1,A2 at location P3 by means of aligned apertures 12*m* defined in the central ribs 10*e*.

More particularly, the two central ribs 10*e* cooperate to define therebetween a link channel C2 adapted to receive an associated tilt link cylinder rod eye or other member that controls the angular position of the male coupler portion A relative to the loader arms connected at points P1,P2. The tilt link or other control members pivotably secured to the male coupler portion A via pin-on connection at the point P3 defined by the aligned apertures 12*m* of the ribs 10*c*. Bosses and pin-retainers are preferably provided in all pin-on locations P1,P2,P3 to ensure proper pin fit and retention for added strength as is generally known in the art.

Each coupler half A1,A2 comprises first, second and third rib locking locations aligned respectively with first, second and third hook-engaging mounts M1*a*,M2*a*,M3*a* (for the coupler half A1) and M1*b*,M2*b* and M3*b* (for the coupler half A2). In the illustrated embodiment the ribs 10*a*,10*b* of each coupler half A1,A2 define therebetween a first lock channel LC1 to provide the first rib locking location. The ribs 10*b*,10*c* of each coupler half A1,A2 define therebetween a second lock channel LC2 to provide the second rib locking location. The ribs 10*c*,10*d* of each coupler half define therebetween a third lock channel LC3 to provide a third rib locking location.

It can be seen at the ribs 10*a*,10*b*,10*c* and 10*d* of each coupler half A1,A2 define respective lock apertures 12*e*,12*f*, 12*h*,12*i*, 12*j* and 12*k* that are aligned in pairs with each other. The lock apertures 12*e* and 12*f* cooperate the first lock channel LC1 the lock apertures 12*h* and 12*i* cooperate to provide the second lock channels LC2 and the lock apertures 12*j* and 12*k* cooperate to define the third lock channel LC3. In other embodiments lock channels LC1, LC2, LC3 may share some common lock apertures 12*e*, 12*f*, 12*h*, 12*i*, 12*j* and 12*k*. Additionally aperture 12*g* provides access to access apertures 12*h* and 12*i* as will be explained below.

Ribs 10*b*,10*c*,10*d*,10*e* of each coupler half A1,A2 are preferably securely fixed to first-upper round (or other shape) steel cross bar/cross member T1 by insertion of member T1 through aligned apertures defined in the ribs 10*b*,10*c*,10*d* of each half of A1,A2 in a welding at the juncture of the member T1 with each of the ribs. A lower cross bar/cross member T2 is spaced vertically from the upper cross member T1. The lower cross bar T2 is welded to the ribs 10*a*-10*e* for at least some embodiments although not all embodiment need not be so constructed. In the illustrated embodiment, the lower cross bar T2 is welded at a lower portion to rib 10*e* so that the cross bar T2 defines a continuous lower skid plate for the frame F. Other embodiments may be constructed differently. Cross members T1,T2 are preferably arranged parallel to each other and perpendicular to ribs 10*a*-10*e*.

With continued reference to the figures, the male coupler portion A comprises a pair of first hook engaging mounts M1*a*,M1*b*, a pair of second hook engaging mounts M2*a*,M2*b* and a pair of third hook engaging mounts M3*a*,M3*b*. More particularly, each of the three pairs of mounts M1*a*,M1*b*, M2*a*,M2*b*,M3*a*,M3*b* are preferably split between coupler halves A1,A2 so that the coupler half A1 comprises the mounts M1*a*,M2*a*,M3*a* and the coupler half A2 comprises the mounts M1*b*,M2*b*,M3*b* with the mounts M1*a*,M1*b* coaxially aligned with one another, the mounts M2*a*,M2*b* coaxially aligned with each other, and the mounts M3*a*,M3*b* coaxially aligned with each other.

First mounts M1*a*,M1*b* are adaptably received into and engaged by hooks FH3 of the first female coupler portion B defined by two of the first ribs FR3. Likewise, the second mounts M2*a*,M2*b* are adapted to be received into and engaged by the hooks FH1 of the second female coupler portion defined by two of the second ribs FR1. Finally, the third mounts M3*a*,M3*b* are adapted to be received into and engaged by the hooks FH2 of a third female coupler portion defined by two of the second ribs FR2.

More particularly, in the illustrated embodiment, each of the first mounts M1*a*,M1*b* comprise a round steel member inserted into an open end of cross member T1 and welded thereto. Alternatively, the mount M1*a*,M1*b*, can be combined as a one-piece constructional cross member T1 for at least some embodiments. Second mounts M2*a*,M2*b* is comprised of a round steel member inserted through aligned apertures and welded to the ribs 10*b*,10*c* of each half A1,A2 of coupler frame F. The third mounts M3*a*,M3*b* is comprised of a round steel member inserted through aligned apertures and welded to the ribs 10*c*,10*d* of each half A1,A2 of the coupler frame F.

The mounts M1*a*,M1*b*,M2*a*,M2*b* and M3*a*,M3*b* can be provided in other arrangements and it is not intended that the invention to be limited to the embodiments disclosed herein. For example the mounts M1*a*,M1*b* may not be connected to or defined as a part of cross member T1 and alternatively can be provided separate from the upward cross member T1. Mounts M2*a*,M2*b* can also be connected to or defined as part of the cross member T1. Similar characterization of the mounts M3*a*,M3*b* can also be provided. In every case, however, it is preferred that the mounts M1*a*,M1*b* each be comprised of a cylinder surface that mates with a cylindrical surface of the hooks FH3 of the ribs FR3, the mounts M2*a*, M2*b* each comprised of a cylindrical surface that mates with a cylindrical surface of the hooks FH1 of the ribs FR1. Furthermore, mounts M3*a*,M3*b* each comprise of a cylindrical surface that mates with a cylindrical surface of the hooks FH2 of the ribs FR2. In this manner, the ribs FR3 can rotate about the mounts M1*a*,M1*b*, the ribs FR1 can rotate about the mounts M2*a*,M2*b* and the ribs FR2 can rotate about the mounts M3*a*,M3*b* during coupling with coupling from an associated female coupler portion.

It should be noted that the first mounts M1*a*,M1*b* are located between ribs 10*a*,10*b* of each coupler half A1,A2 so as to be aligned with the first lock channel LC1 for the preferred embodiment. Ribs 10*a*, 10*b* for this embodiment also define link channels C1. Correspondingly, the second mounts M2*a*,M2*b* are located between ribs 10*b* and 10*c* of each coupler so as to be aligned with second lock channel LC2. Finally, the M3*a* and M3*b* are located between ribs 10*c* and 10*d* of each coupler half A1,A2 so as to be aligned with third lock channel LC3.

With continued reference to the figures, steel face plate 40 extends across the front AF of the coupler A. The steel face plate 40 is preferably welded to all the ribs 10*a*-10*e* of both coupler halves A1,A2 for the preferred embodiment. It is preferred that for added visibility, the plate 40 defines at least a plurality of opening windows W1,W2, and/or W3 through which an operator can visualize the female coupler portion being engaged by coupler A. The plate 40 is preferably of a one-piece construction, but can be defined by separate plates connected to the ribs 10*a*-10*e*.

Figure 6:
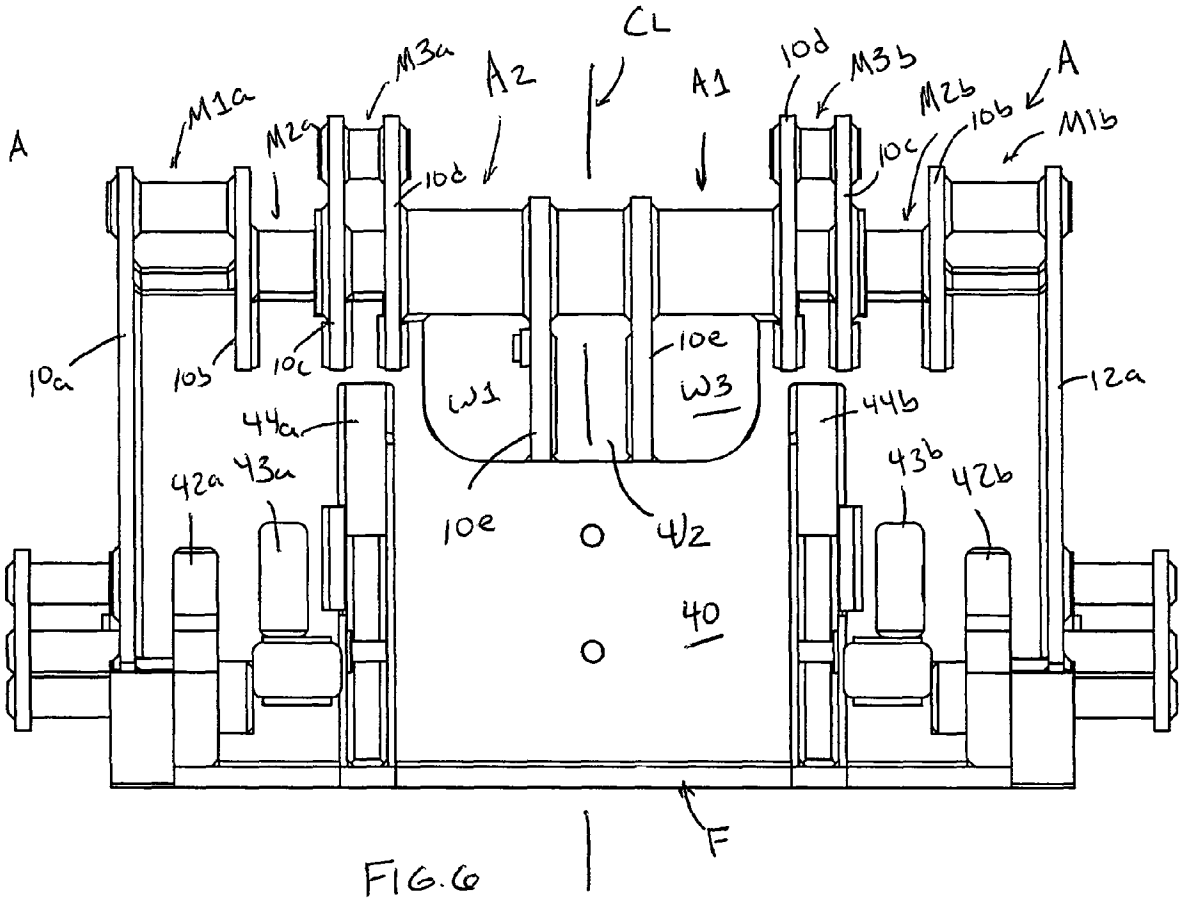
FIG. 6 is a front elevational view of the male coupler of FIGS. 2-5.
Figure 5:
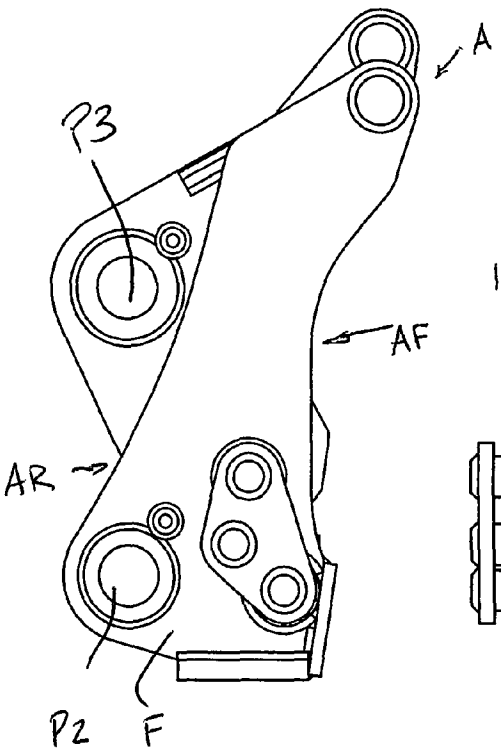
FIG. 5 is a side elevational view of the male coupler of FIGS. 2-4.

As best can be seen by FIG. 6, plate 40 defines a first pair of openings 42*a*,42*b* through which ears FT3 of ribs FR3 project when the male coupler portion A is mated to female coupler B defined by two ribs FR3 (i.e., when the mounts M1*a*,M1*b* of male coupler portion A is two ribs FR3 (i.e., when the mounts M1*a*,M1*b* of the male coupler portion A are fully seated in the hooks FH3 of the two ribs FR3 defined in the female coupler portion). More particularly, the opening 42*a* is aligned with the mount M1*a* and the lock channel LC1 of the coupler half A1 and the opening 42*b* is aligned with the mount M1*b* and the lock channel LC1 of the coupler half A2. As such, when a female coupler portion B defined by two ribs FR3 is operably mated with the male coupler portion A (when the mounts M1*a*,M1*b* are fully received in the hooks FH3 of the ribs FR3), (one of the ears of FT3) projects through plate 40, via opening 42*a* into the lock channel LC1 of the coupler half A1, and the other ear FT3 projects through plate 40 via opening 42*b* into the locked channel LC1 of the coupler half A2.

Similarly, with continuing reference to FIG. 6, the plate 40 defines the second pair of openings 43*a*,43*b* through which the tongues FT1 and other portions of the ribs FR1 are to project when the male coupler portion A is mated with the female portion defined by two ribs FR2 (i.e., when the mounts M2*a*,M2*b* of the male coupler portion A are fully seated in the hooks FH1 of the two ribs FR1 defining the female coupler portion. More particularly, the opening 43*a* is aligned with the mount in M2*a* and the lock channel LC2 of the coupler half A1, and the opening 44*b* is aligned with the male M2*b* and the lock channel LC2 of the coupler half A2. As such, when a female coupler defined by two ribs FR1 is operably mated with the male coupler portion A (when the mounts M2*a*,M2*b* are fully received in the hooks Fill of the ribs FR1), (one of the tongues FT2 projects through the plate 40 via opening 43*a* into the lock channel LC2 of the coupler half A1, and the other tongue FT2 projects through the plate 40 via opening 43*b* into the lock channel LC2 of the coupler half A2.

Furthermore, with continued reference to the figures, the plate 40 defines a third pair of openings 44*a*,44*b* through which the tongue FT2 and other portion of ribs FR2 project when the male coupler portion A is mated with female coupler portion defined by the two ribs FR3 i.e., when the mounts M3*a*,M3*b* of the male coupler portion A are fully seated in the hooks FH2 of the two ribs FR2 defining the female coupler portion. More particularly, the opening 44*a* is aligned with the mount in M3*a* and the channel LC3 of the coupler half A1, and the opening 44*b* is aligned with the mount M3*b* and the lock channel LC3 of the coupler half A2. As such, when a female coupler defined by two ribs FR2 is operably mated with the male portion A (when the mounts M3*a*,M3*b* are fully received in the hooks FH2 of the ribs FR2), one of the tongues FT2 projects through plate 40 through opening 44*a* into the lock channel LC3 of the coupler half A1, and the other tongue FT3 projects through plate 40 via the opening 44*b* into lock channel LC3 of the coupler half A2.

Figure 2:
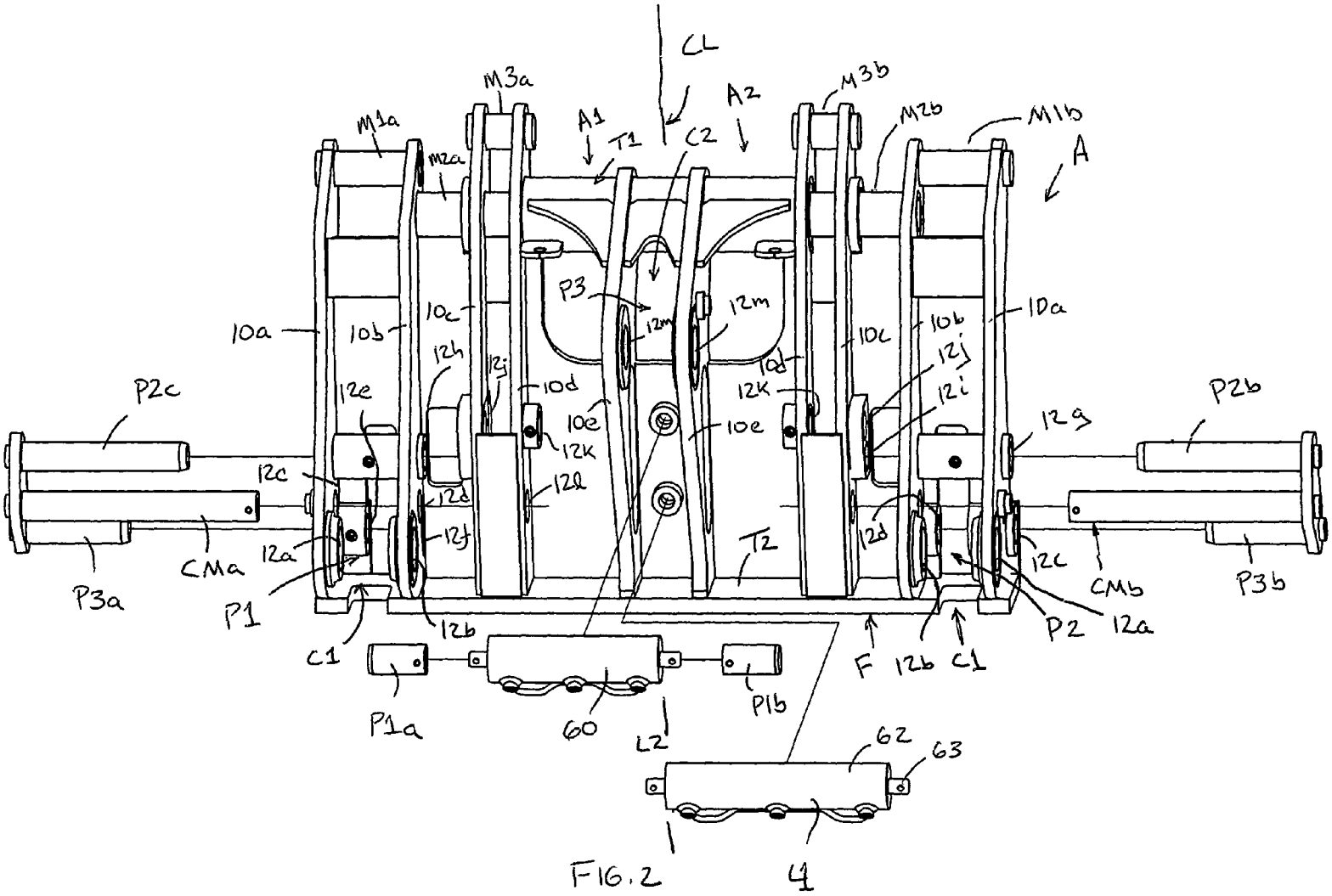
FIG. 2 is a rear elevational exploded view of the male coupler portion of a presently preferred embodiment of the present invention.
Figure 4:
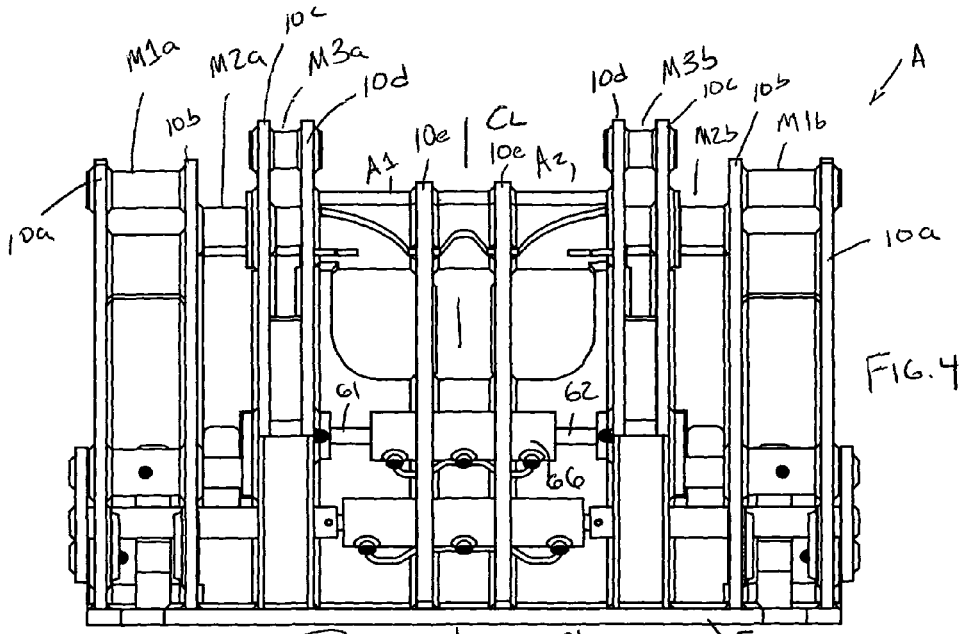
FIG. 4 is a rear elevational view of the male coupler of FIGS. 2-3 shown in a locked configuration.
Figure 3:
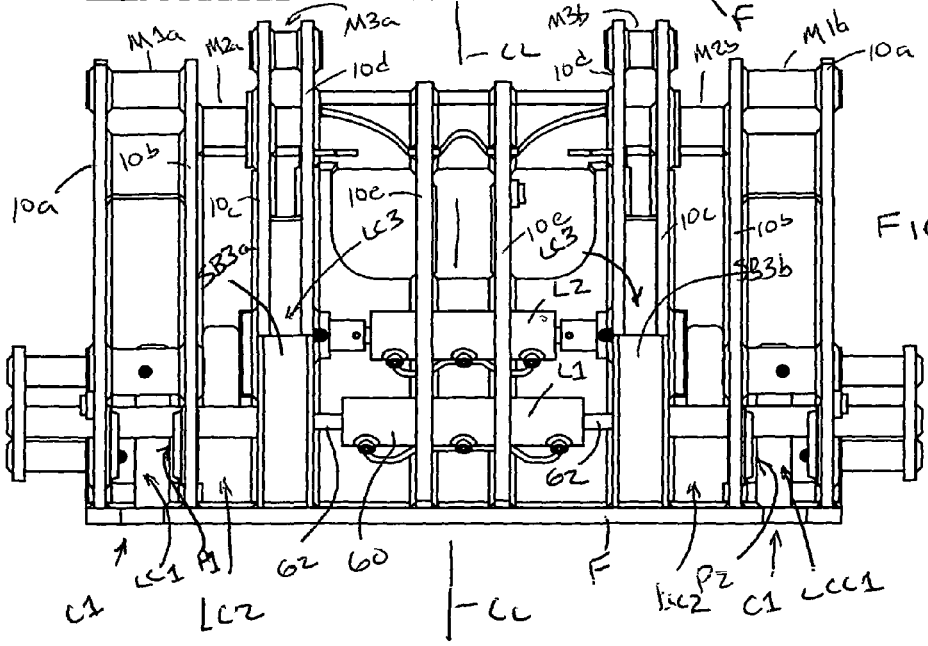
FIG. 3 is a rear elevational view of an assembled male coupler portion as shown in FIG. 2 in an unlocked and disengaged configuration

As briefly noted above, the coupler A comprises first and second lock assemblies L1,L2 as shown in FIGS. 2-4 with reference to these figures, the lock assemblies L1,L2 are preferably comprise an actuator such as a hydraulic screw or cylinder 60 including a first and second rod 61,62 and possibly extender 63 as is known in the art. Lock assemblies L1,L2 are further comprised of plungers and/or plunger assemblies as is shown.

First lock assembly L1 preferably pulls plungers P2*a*, P2*b* and P3*a*, P3*b* through extender 63 which passes through apertures 12*c*,12*d* and 12*l* within lock apertures 12*h* and 12*i* of the coupler halves A1,A2 to direct plungers P2*a* and P2*b* to provide within the lock channel LC2 when extended into a locked configuration as well as P3*a* and P3*b* into lock aperture 12*e* and 12*f* to provide it within lock end LC1. When retracted, the plungers P2*b* and P3*a* and P3*b* are removed from their respective lock channels LC1 and LC2.

Lock assembly L2 works slightly differently for at least the preferred embodiment in that plungers P1*a* and P1*b* as are driven by lock assembly L2 so that P1*a* can be inserted into lock channel LC3 as defined by lock apertures 12*j* and 12*k*. Plunger pins P1*a*-P3*a* and P1*b*-P3*b* have been configured in the preferred embodiment to be received within their respective lock channel LC1-LC3 for the applicant's preferred embodiment. Other embodiments may incorporate the teaching of U.S. Pat. No. 7,225,566 in a single plunger such as any of P1*a*-P3*a* and any of P1*b*-P3*b* may engage multiple lock channels LC1, LC2 and/or LC3. With such an embodiment, there may be the total number pins P1*a*-P3*a* and/or P1*b*-P3*b* may be reduced.

The plunger pins P1*a*-P3*a* and P1*b*-P3*b* are preferably configured to be conformed and dimensioned to the closely (with minimal clearance) and slidably received into the appropriate aligning lock apertures 12*e*-12*f*, 12*h*-12*i*, and 12*j*-12*k* as appropriate in the coupler halves A1-A2, possibly also needing 12*g* for access and/or 12*c*,12*d* and 12*e* to allow for appropriate communication of pins or linkages. In the illustrated embodiment, plunger pins P1*a*-P3*a* and P1*b*-P3*b* and lock apertures 12*c*-121 are cylindrical. Alternatively, lock assemblies L1,L2 could be manually operable plunger pins p1*a*-P3*a* and/or P1*b*-P3*b* could be a moved to and between the locked and unlocked positions.

Lock assemblies L1,L2 are mounted to a rear surface of the face plate 40 and/or two ribs 10*d* and/or 10*d* for various embodiments. Lock assemblies L1,L2 are preferably arranged so that the respective plunger pins P1*a*-P3*a* and/or P1*b*-P3*b* are selectively extendable such as via rods 61,62 and/or 63 such as to extend plunger pins P1*a*-P3*a* and P1*b*-P3*b* into the respective lock channels LC1-LC3 to an adequate locked position. Retraction of the pin P1*a*,P1*b* provides unlocked configuration as it relates to LC2. Furthermore, the extension of rod 63 (movement away from CL) is what retracts plunger pins P2*a*, P2*b*, P3*a*, and P3*b* for at least some embodiments. For other embodiments, all may move away from CL for unlocked, and other embodiments they may rely on similar or dissimilar constructions as L1 or L2. In fact, the single lock assembly such as L1 or L2 could possibly be utilized to drive all one to three plunger pins for some embodiments.

When in the unlocked position, the pins P1*a*-P3*a* and P1*b*-P3*b* are not only unlocked but they are moved out of the lock channels LC1-LC3. Just because the pins P1*a*-P3*a* and P1*b*-P3*b* are out of the lock channels, the respective rib ears FT1,FT2,FT3 are not necessarily moved out of the lock channels LC1-LC3 for coupling/decoupling operations. However, they certainly could be as they are no longer retained by the pins P1*a*-P3*a* and P1*b*-P3*b*.

With the foregoing in mind, the operation of the coupler A should be readily apparent to those of ordinary skill in the art. When the coupler A is mated to female coupler portion B comprising two of the first ribs FR3, the ribs FR3 contact the face plate 40 with one of the hooks FH3 received over and engaged with the first mount M1*a* and the other of the hooks FH1 received over and engaged with the first mount M1*b*. The ears FT3 of the ribs FR3 project through respective plate openings 42*a*,42*b* into the lock channels LC1 of the coupler halves A1,A2 respectively. In this position, the aperture FA3 of each ear FT3 is aligned to be in line with lock apertures 12*e* and 12*f*. The aperture FA3 of each tongue FT3 is also shaped to more closely receive the plunger pin P3*a* and P3*b*. In this position, the ribs FR1 will be secured or captured on the male coupler portion A. The decoupling is accomplished by retracting both pins P3*a* and P3*b* so that the ribs FR3 can be unloaded from the male coupler portion A.

Coupler A can alternatively be made into a female coupler portion comprising two of the second ribs FR1. In this case, the ribs FR1 contact face plate 40, with one of the hooks Fill received over and engaged with the second mount M2*a*. The ears FT1 of other ribs FR1 project through respective plate openings 43*a*,43*b* and into the second lock channels LC2 of the coupler halves A1,A2, respectively. In this position, the apertures FA1 of each ear FT1 is also aligned with the lock apertures 12*a* and 12*c*. The aperture FA1 of each ear FT1 is also shaped to closely receive the plunger pin P2*a* and P2*b* of the relevant lock assembly L1,L2 (L1 as illustrated). As such, with the ribs FR1 set in position, hydraulic cylinder can be actuated to extend the plunger pin P2*a* and P2*b* so that the plunger pins P2*a* and P2*b* are moved to the locked position for each coupler half A1,A2 to be received through the lock channel LC2. In this position, the ribs FR1 are captured on the male coupler portion A. The decoupling is accomplished by retracting both pins P2*a* and P2*b* so that the ribs FR1 can be unmated from the male coupler portion A.

The coupler A can also be made into a female coupler portion comprising two of the third ribs FR2. In this case, the ribs FR2 contact face place 40 with one of hooks FH2 received over and engaged with the third mount M3*a* and the other of the hooks FH2 received over and engaged with the third mount M3*b*. The ears FT2 of the ribs FR2 project through the respective plate openings 44*a*,44*b* into the third lock channel LC3 of the coupler halves A1,A2 respectively. In this position, lock aperture FA2 of each ear FT2 is also aligned with the lock apertures 12*j* and 12*k*. The aperture FA2 of each ear FT2 is also shaped and dimensioned to closely receive the plunger pin P1*a*,P2*a* of the relevant lock assembly (L2 is illustrated). As such, with the ribs FR2 so positioned, the hydraulic cylinder can be actuated to extend the rods so that the plunger P1*a*,P1*b* can move into the extended or locked position with the pin P1A,P1B of each coupler half A1,A2 received through relevant aligned apertures 12*j* and 12*k* and the ear aperture FT2. In this position, the ribs FR2 are captured on the male coupler portion A. The decoupling is accomplished by retracting both pins P1*a* and P1*b* so that the ribs FR2 can be unmated from the male coupling portion A as is known in the art.

Various stop plates and the like are connected to face plate 42 with stop surfaces of the ribs FR1,FR2,FR3 to ensure that the ribs are properly positioned when the male coupler portion is mated therewith. More particularly, the male coupler portion comprises a first pair of stop blocks SB1*a*,SB1*b* that engage the ribs stop block SBR1 of respective first and second ribs FR3 to the position that the ribs FR3 properly when they are mated with the male portion A. Likewise, the male coupler portion comprises a second portion of the stop blocks SB2*a*, SB2*b* and engage the ribs with stop block SBR2 of respective first and second ribs FR1 to position ribs FR1 properly when mated with male coupler portion A. Finally, the male coupler portion comprises a third pair of stop blocks SB3*a*,SB3*b* that engage a rib stop block SBR3 of respective first and second ribs FR2 to position the ribs FR2 properly when they are mated with the male coupler portion A.

None of the prior art is believed to cooperate with three different options of attachments having three different kinds of ear configurations. None of the prior art designs are believed to operate with plungers such as P2*a*, P2*b*, or P3*a*, P3*b* extending the lock configurations from a distance further away from the center line to a distance closer to the center line when extended from the unlocked to the locked configuration for at least some of the locked positions. Furthermore, none of the prior art is known to have two locked assemblies which respectively direct plunger pins in different directions into a locked configurations at the same time (P1*a* and P1*b* extend from closer to the center line of the coupler A to farther away from the center line of coupler A to the locked configuration while P2*a*,P2*b* and P3*a*,P3*b* initially start out further away from the center line and end up closer to the center line in the locked configuration). Finally, ribs 10*a* and 10*b* not only define lock LC1, but also arm receiving channels C1 and C2 for at least some embodiments Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A male coupler portion adapted to mate with at least three different associated female coupler portions having three different hook spacing distances, said male coupler portion comprising:

a frame comprising:

(i) first and second arm connection locations adapted for connection to associated first and second arms, respectively;

(ii) at least one tilt member connection location adapted for connection to an associated tilt member;

(iii) first and second coupler halves each comprising:

a first hook-engaging mount defined by a first member that is fixedly secured to and extends between first and second vertical ribs, said first hook-engaging mount adapted to be received into a hook of a female rib of a first associated female coupler portion;

a first rib locking location comprising a first locking channel defined between said first and second vertical ribs so as to be vertically aligned with said first hook-engaging mount;

a second hook-engaging mount internally disposed relative to the first hook-engaging mount and defined by a second member that is fixedly secured to extends between said second vertical rib and a third vertical rib, said second hook-engaging mount adapted to be received into a hook of a female rib of a second associated female coupler portion that is different from the first associated female coupler portion having at least a shorter distance between hooks;

a second rib locking location comprising a second locking channel defined between said second and third vertical ribs so as to be vertically aligned with said second hook-engaging mount;

a third hook-engaging mount internally disposed relative to the second hook-engaging mount and defined by a third member that is fixedly secured to extends between said third vertical rib and a fourth vertical rib, said third hook-engaging mount adapted to be received into a hook of a female rib of a third associated female coupler portion that is different from the first and second associated female coupler portions having at least a shorter distance between hooks;

a third rib locking location comprising a third locking channel defined between said third and fourth vertical ribs so as to be vertically aligned with said third hook-engaging mount; and, at least one plunger pin slidably connected to the frame and movable between a locked position and a retracted position, said at least one plunger pin, when locked, adapted to engage and retain an associated female coupler portion rib ear located in at least one of the first, second, and third rib locking channels, with the at least one plunger pin located in the first second, and third locking locations in the locked configuration and out of the first, second and third locking locations in the retracted position.

2. The male coupler portion of claim 1, wherein movement of at least one of the at least one plunger pin from the retracted to the locked position is from a position farther away from a centerline of the coupler portion and external to at least the third rib to a position closer to the centerline of the coupler.

3. The male coupler portion of claim 2 wherein the at least one pin further comprises at least two plunger pins, and at least one of the at least two plunger pins moves from the retracted to the locked position by moving from a position closer to the centerline of the coupler portion to a position farther away from the centerline of the coupler.

4. The male coupler portion of claim 1 wherein the first and second arm connection locations are located between the first and second vertical ribs.

5. The male coupler portion of claim 1 wherein the at least one plunger pin further comprises three plunger pins which cooperate with the first, second and third rib locking locations, respectively in the locked configuration, and are moved out of the first, second and third locking locations in the retracted position.

6. A male coupler portion adapted to mate with at least one associated female coupler portion, said male coupler portion comprising:

a frame comprising:

(i) first and second arm connection locations adapted for connection to associated first and second arms, respectively;

(ii) at least one tilt member connection location adapted for connection to an associated tilt member;

(iii) first and second coupler halves each comprising:

a first hook-engaging mount defined by a first member that is fixedly secured to and extends between first and second vertical ribs, said first hook-engaging mount adapted to be received into a hook of a female rib of a first associated female coupler portion;

a first rib locking location comprising a first locking channel defined between said first and second vertical ribs so as to be vertically aligned with said first hook-engaging mount; and, at least one plunger pin slidably connected to the frame and movable between a locked position externally disposed relative to the centerline past at least one of the first and second rib, and a retracted position with the pin closer to a centerline of the coupler when in the locked position than in the retracted position, said at least one plunger pin, when locked, adapted to engage and retain an associated female coupler portion rib ear located in the first rib locking channel, and when in the retracted position, release the associated female coupler portion rib ear.

7. The male coupler portion of claim 6 further comprising:

a second hook-engaging mount defined by a second member that is fixedly secured to extends between said second vertical rib and a third vertical rib, said second hook-engaging mount adapted to be received into a hook of a female rib of a second associated female coupler portion that is different from the first associated female coupler portion having at least a shorter distance between hooks;

a second rib locking location comprising a second locking channel defined between said second and third vertical ribs so as to be vertically aligned with said second hook-engaging mount; and wherein the at least one plunger pin locks the associated female coupler portion rib ear in one of the first and second rib locking locations in the locked position.

8. The male coupler portion of claim 7 wherein movement of the at least one pin which engages the associated female coupler portion rib ear in the second rib locking location communicates through an opening through the first vertical rib during movement between the locked and retracted positions.

9. The male coupler portion of claim 7 wherein the at least one pin further comprises at least two pins, and at least one of the at least two plunger pins moves from the retracted to the locked position by moving from a position closer to the centerline of the coupler portion to a position farther away from the centerline of the coupler.

10. The male coupler portion of claim 7 further comprising:

a third hook-engaging mount defined by a third member that is fixedly secured to extends between said third vertical rib and a fourth vertical rib, said third hook-engaging mount adapted to be received into a hook of a female rib of a third associated female coupler portion that is different from the first and second associated female coupler portions having at least a shorter distance between hooks;

a third rib locking location comprising a third locking channel defined between said third and fourth vertical ribs so as to be vertically aligned with said third hook-engaging mount; and wherein the at least one plunger pin locks the associated female coupler portion rib ear in one of the first, second and third rib locking locations in the locked position and releases the associated female coupler portion rib ear in the retracted position.

11. The male coupler portion of claim 10 wherein the at least one plunger pin further comprises at least two plunger pins which lock the associated female coupler portion rib ear in the one of the first, second and third rib locking locations in the locked configuration and releases the associated female coupler portion rib ear in the retracted position.

12. The male coupler portion of claim 11 wherein the at least one plunger pin further comprises three plunger pins which separately cooperate with the first, second and third rib locking locations, respectively in the locked configuration, and move out of the first second and third rib locking locations in the retracted configuration.

13. The male coupler portion of claim 6 wherein the first and second arm connection locations are located between the first and second vertical ribs.

14. A male coupler portion adapted to mate with at least two different associated female coupler portions having different hook spacing distances, said male coupler portion comprising:

a frame comprising:

(i) first and second arm locations adapted for connection to associated first and second arms, respectively;

(ii) at least one tilt member location adapted for connection to an associated tilt member;

(iii) first and second coupler halves each comprising:

a first hook-engaging mount defined by a first member that is fixedly secured to and extends between first and second vertical ribs, said first hook-engaging mount adapted to be received into a hook of a female rib of a first associated female coupler portion;

a first rib locking location comprising a first locking channel defined between said first and second vertical ribs so as to be vertically aligned with said first hook-engaging mount;

a second hook-engaging mount defined by a second member that is fixedly secured to extends between said second vertical rib and a third vertical rib, said second hook-engaging mount adapted to be received into a hook of a female rib of a second associated female coupler portion that is different from the first type of associated female coupler portion, by having at least a shorter distance between hooks;

a second rib locking location comprising a second locking channel defined between said second and third vertical ribs so as to be vertically aligned with said second hook-engaging mount; and, at least two plunger pins slidably connected to the frame and movable between a locked position and a retracted position, said plunger pins, when locked, adapted to engage and retain an associated female coupler portion rib ear located in at least one of said first, and second rib locking channels, respectively, wherein a first one of the plunger pins moves from the retracted position external relative to the centerline of the coupler past the third rib to the locked position by moving from further away from a centerline of the coupler portion to closer to the centerline of the coupler portion than when in the retracted position, and a second one of the plunger pins moves from closer to the centerline to further away from the centerline when moving from the retracted to the locked position.

15. The male coupler portion of claim 14 further comprising:

a third hook-engaging mount defined by a third member that is fixedly secured to extends between said third vertical rib and a fourth vertical rib, said third hook-engaging mount adapted to be received into a hook of a female rib of a third associated female coupler portion that is different from the first and second types of associated female coupler portions by having a shorter distance between hooks than the first and second associated female coupler portions;

a third rib locking location comprising a third locking channel defined between said third and fourth vertical ribs so as to be vertically aligned with said third hook-engaging mount; and wherein the at least two plunger pins lock the associated female coupler portion rib ear in one of the first, second and third rib locking locations when in the locked position and release the associated female coupler rib ear when in the retracted position.

16. The male coupler portion of claim 14 wherein the at least one plunger pin further comprises three plunger pins which cooperate with the first, second and third rib locking locations, respectively in the locked configuration.

17. The male coupler portion of claim 14 wherein the first and second arm locations are located between the first and second vertical ribs.

* * * * *